US007347158B2

(12) United States Patent
Hawkes

(10) Patent No.: US 7,347,158 B2
(45) Date of Patent: Mar. 25, 2008

(54) SAFETY SYSTEM FOR SCUBA DIVERS OPERATING UNDERWATER PROPULSION DEVICES

(76) Inventor: Graham Hawkes, 27 Oakwood Ave., San Anselmo, CA (US) 94960

( * ) Notice: Subject to any disclaimer, the term of this patent is extended or adjusted under 35 U.S.C. 154(b) by 0 days.

(21) Appl. No.: 11/546,835

(22) Filed: Oct. 12, 2006

(65) Prior Publication Data

US 2007/0137551 A1 Jun. 21, 2007

Related U.S. Application Data

(63) Continuation-in-part of application No. 10/763,041, filed on Jan. 22, 2004, now Pat. No. 7,131,389.

(60) Provisional application No. 60/733,151, filed on Oct. 18, 2005.

(51) Int. Cl.
*B63C 11/46* (2006.01)

(52) U.S. Cl. ..... 114/315; 114/312; 114/330

(58) Field of Classification Search ..... 114/312, 114/315, 330

See application file for complete search history.

(56) References Cited

U.S. PATENT DOCUMENTS

| | | | | |
|---|---|---|---|---|
| 5,159,218 | A * | 10/1992 | Murry et al. | 310/68 B |
| 5,469,803 | A * | 11/1995 | Gallo | 114/315 |
| 5,509,372 | A * | 4/1996 | Culotta | 114/315 |
| 6,474,255 | B2 * | 11/2002 | Geriene et al. | 114/312 |
| 6,698,373 | B2 * | 3/2004 | Geriene et al. | 114/244 |
| 6,848,385 | B2 * | 2/2005 | Mah | 114/315 |
| 6,901,876 | B2 * | 6/2005 | Geriene et al. | 114/244 |

* cited by examiner

*Primary Examiner*—Lars A. Olson

(57) ABSTRACT

A safety system for underwater propulsion devices operated by scuba divers includes sensors that detect the vertical velocity of the device. If the descent or ascent is greater than 60 feet per minute, the system reduces the vertical speed by changing the pitch of the device or reducing the speed of the device. By regulating the vertical speed, the device can be used safely with less chance of injury to the scuba diver due to rapid compression or decompression.

6 Claims, 6 Drawing Sheets

SAFETY SYSTEM FOR SCUBA DIVERS OPERATING UNDERWATER PROPULSION DEVICES

CROSS REFERENCE TO RELATED APPLICATIONS

The present invention is a continuation in part of patent application Ser. No. 10/763,041, "WINGED SUBMERSIBLE" filed on Jan. 22, 2004 now U.S. Pat. No. 7,131,389 and also claims priority to Provisional Patent Application No. 60/733,151, "SAFETY SYSTEM FOR SCUBA DIVERS OPERATING UNDERWATER PROPULSION DEVICES" filed on Oct. 18, 2005. Both U.S. Patent Applications are hereby incorporated by reference.

BACKGROUND

SCUBA (Self-Contained Underwater Breathing Apparatus) operations typically require that rate of change in depth be limited to typically no more than 60 feet per minute. This maximum rate of change in depth gives the divers' bodies enough time to assimilate to the pressure change. Exceeding this rate can cause damage to inner ears and more serious pressure-related medical difficulties such as embolism and the bends. During normal scuba diving without any supplemental propulsion, it is fairly easy to stay below this maximum rate of change in depth. When scuba divers travel faster through the water using propulsion devices, it become much easier to exceed the maximum rate of change in depth.

Propelled underwater movement has many advantages over normal underwater human powered travel. These supplemental propulsion devices provide faster underwater movement and allow a diver to cover greater areas and travel farther when underwater time is limited. Almost all underwater activities are limited by the supply of air available to the diver and the stored power available for the propulsion mechanism that is typically an electric motor. Examples of propelled underwater movement include a powered water scooter that pulls the operator underwater and more sophisticated submersibles that allow one or more divers ride inside or on a propelled craft. These enhanced underwater speed capabilities are useful in military operations (swimmer delivery vehicles) as well as recreational, sport, commercial, and scientific driving activities using SCUBA equipment.

SUMMARY OF THE INVENTION

The present invention is a device that regulates the rate of descent and assent of a powered underwater device that is operated by a diver who is exposed to the ambient water pressure. This patent application discloses various methods for controlling or regulating the rate of ascent or descent of a powered underwater device.

In an embodiment the inventive depth regulator is integrated into the controller of an underwater craft (preferably a flying type). Such an underwater winged submersible is described in the co pending U.S. patent application Ser. No. 10/763,041, WINGED SUBMERSIBLE. Typically the pilot and passengers are using SCUBA (Self-Contained Underwater Breathing Apparatus) and are exposed to the ambient underwater pressure. While driving the vehicle, it can be very easy to ascend or dive at a rate faster than 60 feet per minute.

There are several ways to control the underwater propulsion device. In an embodiment, a depth transducer can be coupled to a mechanism that automatically controls the rate of ascent or descent of the submersible to remain within safe limits for the human pilot and passengers. The mechanism can be the propulsion throttle and/or a pitch controller. If the rate of ascent or descent exceeds a predetermined value such as 60 feet per minute, the system can reduce the throttle to slow the submersible or change the pitch control to slow the vertical movement.

In another embodiment, the control system may have a speed transducer and an inclinometer. In this embodiment, the system may detect the angle of the submersible and regulate the speed and or pitch so that the vertical speed component remains within a predetermined value. The vertical speed is the submersible speed (V) multiplied by the sine of the angle ($\alpha$) of the submersible, $V_{vertical}=V_{submersible}$ sin $\alpha$.

In addition to the rate of ascent, the system may also be able to slow the rate of ascent when the propulsion device reaches the surface of the water. It can be very dangerous for a submersible to approach the surface of the water with too much speed. As the submersible reaches the surface, it can be propelled out of the water. Potential damage can occur as the submersible falls back into the water. In an embodiment, the present invention can prevent the operator from propelling the submersible out of the water by detecting the rate of ascent and the depth. If the vertical velocity is above a predetermined value at a shallow depth, the system can reduce the speed and or reduce the pitch to slow the submersible as it gets close to the surface.

In other embodiments, the submersible may not have humans as passengers and the ascent/descent regulator may be set to a much faster rate of ascent and descent. For example, for an unmanned submersible the maximum ascent and descent rates.

DETAILED DESCRIPTION

When the powered submersible is operated, it can travel through the water in a pure horizontal direction or a direction that causes at least some vertical movement, either up or down. When the submersible moves horizontally through the water, the rate of descent or ascent is 0 feet per minute. Because there is not change in vertical movement, the speed of the submersible will not affect the rate of ascent or descent. Since the speed does not cause any vertical movement, the inventive regulator does not need to limit the speed. Thus, the operator can apply full throttle and the inventive regulator will not intervene.

Figure 1:
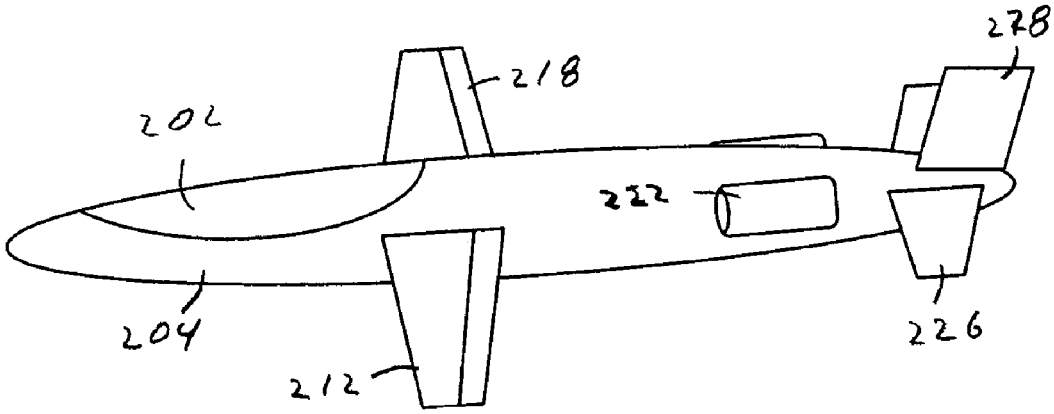
FIG. 1 is a view of a winged submersible.

An example of a high technology propelled submersible is the Deep Flight vessel that is designed to "fly" underwater in a manner that is similar to a fixed winged aircraft rather than operating it under static forces of buoyancy and vectored thrust as in conventional submersibles. In the preferred embodiment, there is a mechanical linkage from the joystick and rudder bars to pitch, roll and heading control surfaces. In the preferred embodiment, the thrusters are electronically controlled. With reference to FIG. 1, an illustration of the winged submersible 101 is shown which includes a cockpit 202, a body 204, wings 212, wing ailerons 218, thrusters 222, elevators 226 and a rudder 228.

In addition to being capable of very fast travel through the water, the winged vessel is also highly maneuverable. While maneuverability is highly desirable, it also can cause some problem because these underwater vehicles can easily exceed the maximum safe rates for both ascent and descent causing injury to the divers. Divers piloting these vehicles need to remain vigilant not to exceed the safe rate of descent and assent limits by constantly monitoring a depth gage. Without constant attention to depth, the pilot of the device can easily be distracted and not recognize that the propulsion device is being driven at an angle and speed that is not safe. As the performance and speed of the craft improves, the craft potentially becomes more dangerous.

During the testing of powered underwater submersibles, the test pilots routinely hurt their ears by ascending or descending too quickly. Although the test pilots were well aware of the dangers of ascending and descending too quickly, they also found it very difficult to remain within recommended ascent and descent rate limits. Because of this experience, it was realized that automatic control over, or a device that controls the rate of ascent and descent would be useful in protecting pilots and passengers of the wet sub or any other powered underwater devices. Such an automated device may be critical to the safety of the divers particularly if propelled underwater craft become more widely used by the public, military and commercial divers.

Figure 2:
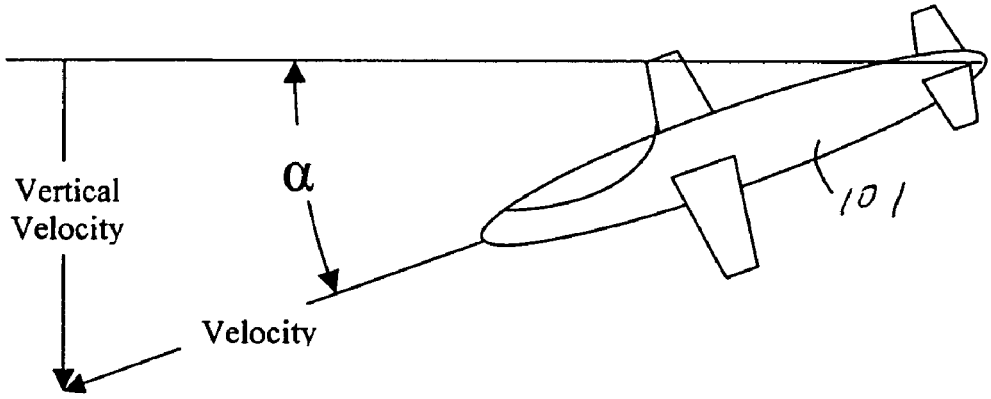
FIG. 2 is a side view of a submersible angled downward.

With reference to FIG. 2, in order to change depth, the submersible 101 is inclined down away from horizontal. Any movement of the submersible at an angle that is not horizontal will result in a vertical movement. The inclinometer detector will sense this angle and the regulator will calculate the rate of ascent or descent based upon the speed and angle of the submersible. A craft moving at speed V and inclined away from the horizontal by $\alpha$ degrees will have a rate of descent equal to $V \times SIN\ \alpha$. If the speed or downward angle is increased, the rate of descent will also increase. Conversely, if the speed or downward angle is decreased the rate of descent will also decrease. When the inventive regulator detects an angle of inclination that it not horizontal, it regulates the speed of the submersible so that the programmed maximum ascent and descent rates are not exceeded.

As an example, if the maximum allowable rate of descent or ascent is 60 feet per minute and the maximum thrust (propulsive power) of the submersible produces a maximum speed of 10 feet/sec (600 ft/min, 5.925 knots) in any direction. This maximum speed can be very unsafe if the vehicle is vertically oriented because the maximum speed would be ten times the safe vertical velocity.

There are maximum allowable velocities for each angle of underwater flight that falls within the maximum allowable rate of descent/ascent. These velocities are listed in table 1 below. The angles apply to both ascent and descent.

TABLE 1

| | Angle $\alpha$ | | | | | | |
|---|---|---|---|---|---|---|---|
| | 0° | 5° | 6° | 7° | 8° | 9° | 10° |
| Max. Velocity (ft/minute) | 600 | 600 | 574 | 492 | 431 | 383 | 345 |
| (knots) | 5.925 | 5.925 | 5.668 | 4.859 | 4.256 | 3.782 | 3.407 |
| % of maximum velocity | 100% | 100% | 95% | 82% | 71% | 63% | 57% |
| | Angle $\alpha$ | | | | | | |
| | 12.5° | 15° | 30° | 45° | 60° | 75° | 90° |
| Max. Velocity (ft/minute) | 277 | 231 | 120 | 84 | 69 | 62 | 60 |
| | 2.735 | 2.811 | 1.185 | 0.830 | 0.981 | 0.612 | 0.593 |
| % of maximum velocity | 46% | 38% | 20% | 14% | 11% | 10.3% | 10% |

At any angle $\alpha$ of descent or ascent between 0° and 5°, the maximum velocity is only limited by the 600 ft/sec maximum speed of the submersible. As the angle of the submersible increases, the maximum safe speed of the craft must be quickly decreased to remain within the 60 ft/sec maximum rate of ascent or descent.

Based upon these parameters, the descent/ascent controller would regulate the thrust setting based upon the detected angle of submersible. If the submersible is horizontal, the maximum thrust may cause the submersible to move at a speed of 600 ft per second. Any speed is allowed because when the submersible travels horizontally, the rate of ascent or descent is 0 at all speeds. The regulator would allow the maximum thrust and maximum velocity of 5.925 knots for any inclination angles between +5.7 degrees and −5.7 degrees away from horizontal. If the pilot increased the inclination angle beyond that to about 11 degrees away from horizontal, then the thrust ascent/descent regulator would reduce the thrust so the speed drops to about 3 knots. This reduction of speed as the angle away from horizontal increases causes the submersible to stay within the maximum allowable rate of ascent/descent of 60 feet/min. There is an inverse relationship between the angle and the speed to remain within the maximum allowable rate of ascent and descent. By controlling the thrust and speed, the rate of ascent/descent will always be equal to or less than 60 feet/min. If the pilot continued to increase pitch angle to vertical either straight up or down, the regulator will reduce the thrust so that the speed is not more than 60 feet/min.

In its simplest form, the inventive ascent/descent regulator has an inclinometer that detects the angle of inclination that is coupled to a controller. The controller detects the engine throttle and prevents the throttle from exceeding a predetermined speed for the angle of the submersible. See table 1 above. The system prevents the operator from operating the submersible in a manner that will cause injury due to an excessive rate of ascent or descent. More specifically, when the inventive regulator senses that the operator may be ascending or descending too quickly, it will reduce the power applied to the motors to keep the submersible exceeding a speed of ascent or descent that is safe.

The inclinometer can be a weight that is attached to the end of a pendulum. When the submersible is horizontal, the pendulum will rest at a 90 degree angle to the horizontal plane of the submersible. If the submersible is inclined, the pendulum will swing off center. The system can detect this swing in the pendulum and regulate the maximum output of the motor to control the velocity of the submersible. Alternatively, for a flying submersible, the mechanical pendulum flight control system could be coupled to the wings to keep pitch inside simple fixed safe limits. Or a completely separate mechanical pitch control system could be installed again using a pendulum to force the craft into near horizontal flight as the operator increases the speed of the craft.

Although purely mechanical system are possible, an electronic systems acting on the thrust is greatly preferred since it intelligently allows the pilot to 'fly' at any pitch. If the submersible is fixed in weight and displacement so that, with crew on board, the submersible is close to neutral buoyancy at all operating depths or slightly positive in buoyancy. Because it is preferable for the craft to have a positive buoyancy, the ascent speed for given thrust would be faster than descent speed for the same thrust. More specifically, the buoyant force would assist the craft in ascending but work against the craft as it descends. In an electrical drive system, the thrust is proportional to the electrical amperage that is applied to the motor. However, this can be factored into the calculations performed by the microprocessor to account for the buoyancy effects.

At zero thrust, the craft would automatically ascend under positive buoyancy alone. Hence positive buoyancy needs to be limited such that maximum rate of ascent cannot be exceeded under those conditions. Note for craft that are substantially underwater flyers, then wing forces easily override positive or negative buoyancy forces. Therefore, the safest form of the craft will have a significant positive buoyancy, but limited such that with zero thrust, the ascent rates remain acceptable.

The preferred form of rate control acting solely on the thrust is thought to be preferable for sport diving, since there is zero interference with the pitch and roll flight control. Thus flight control can be can be simple mechanical linkages and the "safety rate pilot" only overrides the thrust which will be intuitively felt. The pilot will feel when the thrust is automatically reduced and when the pitch limit is actuated without having to monitor the instrumentation of the submersible.

Figure 3:
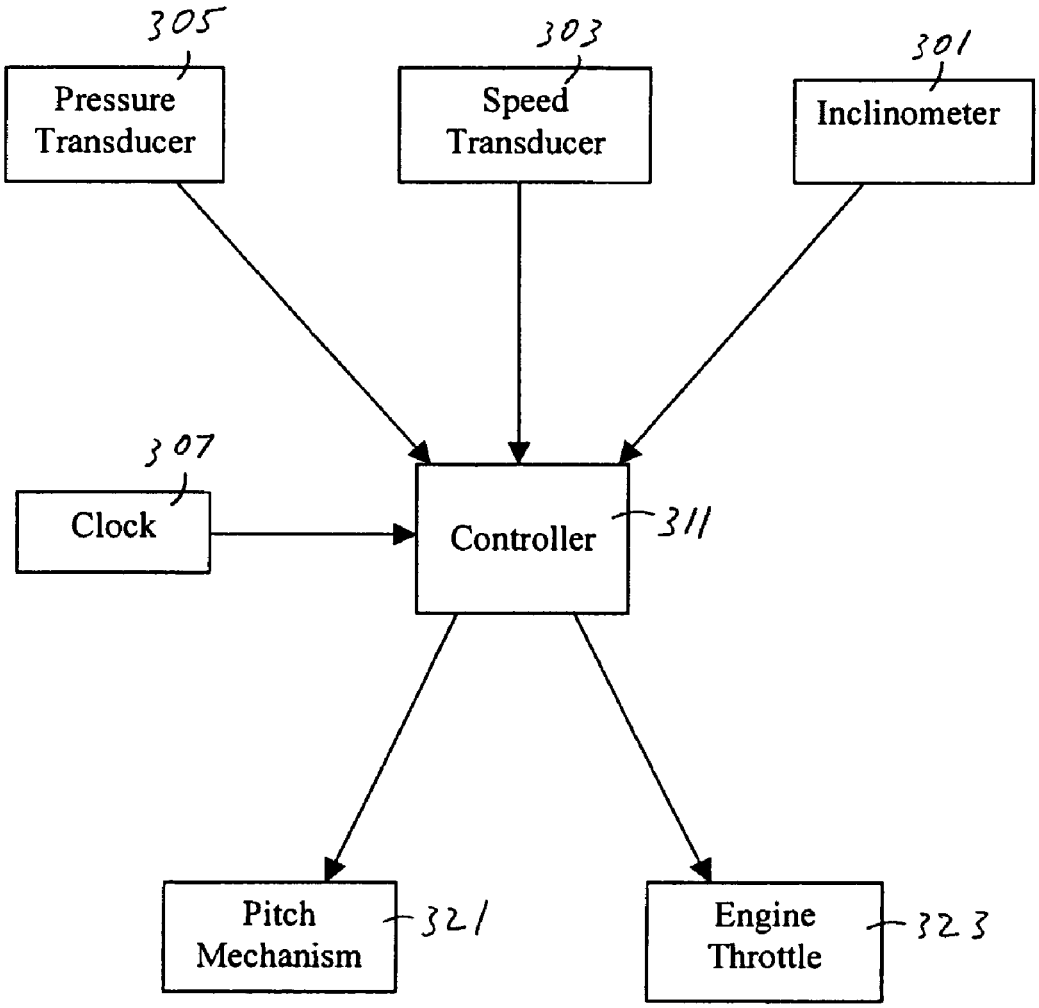
FIG. 3 is a block diagram of the safety control system.

With reference to FIG. 3, the various sensors, controllers and submersible controls are illustrated in a block diagram. The controller 311 obtains data from the sensors and controls the pitch 321 and/or throttle 323 of the submersible based upon the sensed data. The sensors include a pressure transducer 305, a speed transducer 303 and an inclinometer 301. The inventive system may include some of the sensors and control mechanisms rather than all of the listed components. Below are descriptions of the system operations.

For more advanced submersible control systems, "fly by wire" actuators and controllers may be used to make pitch adjustments through the elevators of the submersible. In this embodiment, the controller 311 may be coupled to an autopilot that can intervene to take over pitch control 321 from the operator. The system may also be able to take over control of both the pitch 321 and thrust mechanisms 323. It should be noted that it be hazardous to have a system that can override the pilot's ability to control pitch because the ability to control the pitch angle may be necessary to avoid underwater obstacles.

In the preferred design, the autopilot is flexible micro processor-based control system that is able to sense the descent/ascent rate. Several means are possible for detecting the rate of descent and ascent. The safest system would employ redundant and separate means/sensors for detecting the angle and the speed of the submersible and the change in ambient water pressure with a pressure transducer 305 and clock 307. The preferred control method uses an inclinometer 301 sensor that feeds the input pitch angle directly into the micro processor controller 311.

In an alternative method for determining descent/ascent rate, an electronic depth sensor or pressure sensor 305 and a microprocessor 311 are used to calculate pressure change over short time intervals to calculate the rate of pressure change. If the rate of pressure change is too high, the system can reduce the thrust until the rate of pressure change returns to an acceptable level. There is a direct relationship between pressure and depth and the density of the water. Saltwater has a higher density than fresh water. Pressure at various ocean depths can be expressed in units of pounds per square inch, PSI. Pressure in the ocean increases one atmosphere (14.7 psi) for about every 33 feet of depth in seawater. For example, at a depth of 99 feet, the absolute pressure would be about four atmospheres (58.8 psi), or four times greater than on the surface. The absolute pressure is the sum of the atmospheric pressure (14.7 psi) plus the water pressure, which is 0.4455 psi/ft of depth. The absolute pressure at a depth of 6,000 feet is more than 2,687 pounds per square inch.

Because there is a linear relationship between water pressure and depth, the maximum allowable change in pressure can be determined. The maximum vertical velocity of 60 ft/minute is equal to a change of about 26 psi per minute. Thus, the system may continuously measure the change in pressure and if the change in pressure exceeds 26 psi per minute over a few seconds, the system will cause the submersible to reduce or in extreme emergencies possibly even reverse its thrust until the rate of change in pressure falls within the acceptable range. This method has the advantage of determining the actual descent and ascent most directly as affected both by speed/pitch and by positive or negative buoyancy.

The safest system would use both methods for determining pressure rate and cutting thrust if either indicated limits were being exceeded. Such a dual system for sensing pressure rate could continually compare and monitor the health of the system. If an excessive rate of change in pressure is detected, the system can safely shutting down the thrust and giving an error warning. In all of the microprocessor controlled system, special software is required to perform the sensor analysis and issue the corresponding control signals. An alternative to a software and micro processor-controlled autopilot would be a hard wired analog or Application Specific Integrated Circuit (ASIC) digital electronic circuit to achieve the same or similar effect.

The thrust is also sensed electronically simply (preferred) as a measure of the current running through the motor as this normally equates in a linear relationship with the thrust. Thus, if the microprocessor knows thrust for a given craft, it can compute V, or the programmed software can include a database that includes a "thrust v speed" table. By knowing the pitch angle and speed, the controller 311 can compute descent/ascent rate factoring positive or negative buoyancy.

The speed detector 303 can be a mechanical paddlewheel or ultrasonic sensor to detect the speed of the submersible.

Figure 4:
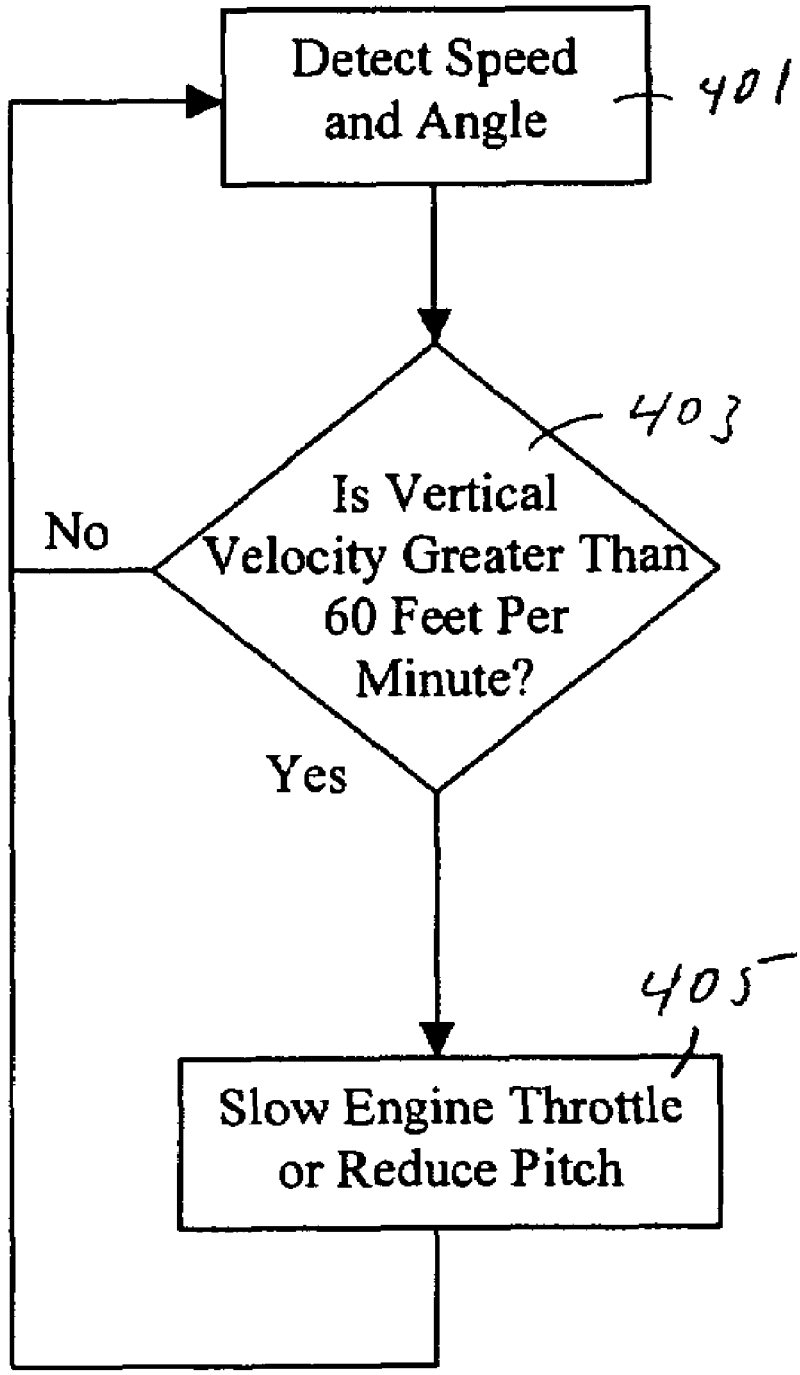
FIG. 4 is a control system flow chart.

FIG. 4 is a flow chart of the operation of the submersible controller using an inclinometer and speed sensor. The system detects the speed and angle of the submersible 401. The system calculates the vertical velocity based upon the formula $V_{vertical}=V\times SIN\ \alpha$. The system then monitors the vertical speed 403. If vertical velocity is less than 60 feet per minute, the system continues to monitor the speed and angle 401. If vertical velocity is greater than 60 feet per minute, the system slows the engine and/or reduces the pitch to reduce the vertical velocity 405. The system then rechecks the speed and angle 401.

Figure 5:
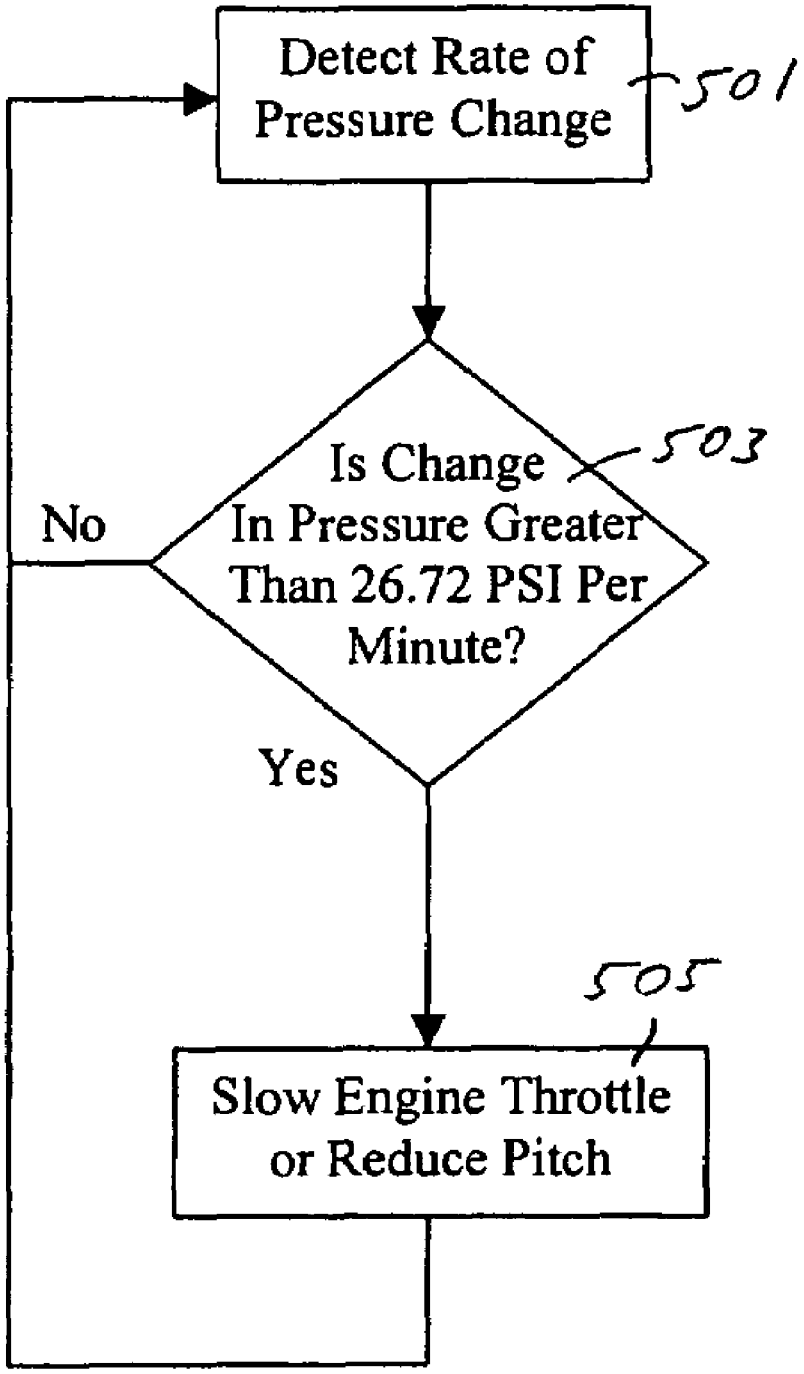
FIG. 5 is a control system flow chart.

FIG. 5 is a flow chart of the operation of the submersible controller using a pressure transducer and a clock. The system detects the rate of pressure change 501. If change in pressure is less than 26.72 PSI per minute 503, the system continues to monitor the change in pressure 501. If change in pressure is greater than 26.72 PSI per minute, the system slows the engine or reduces the pitch to reduce the vertical velocity and pressure change 505. The system then rechecks the change in pressure 501.

Figure 6:
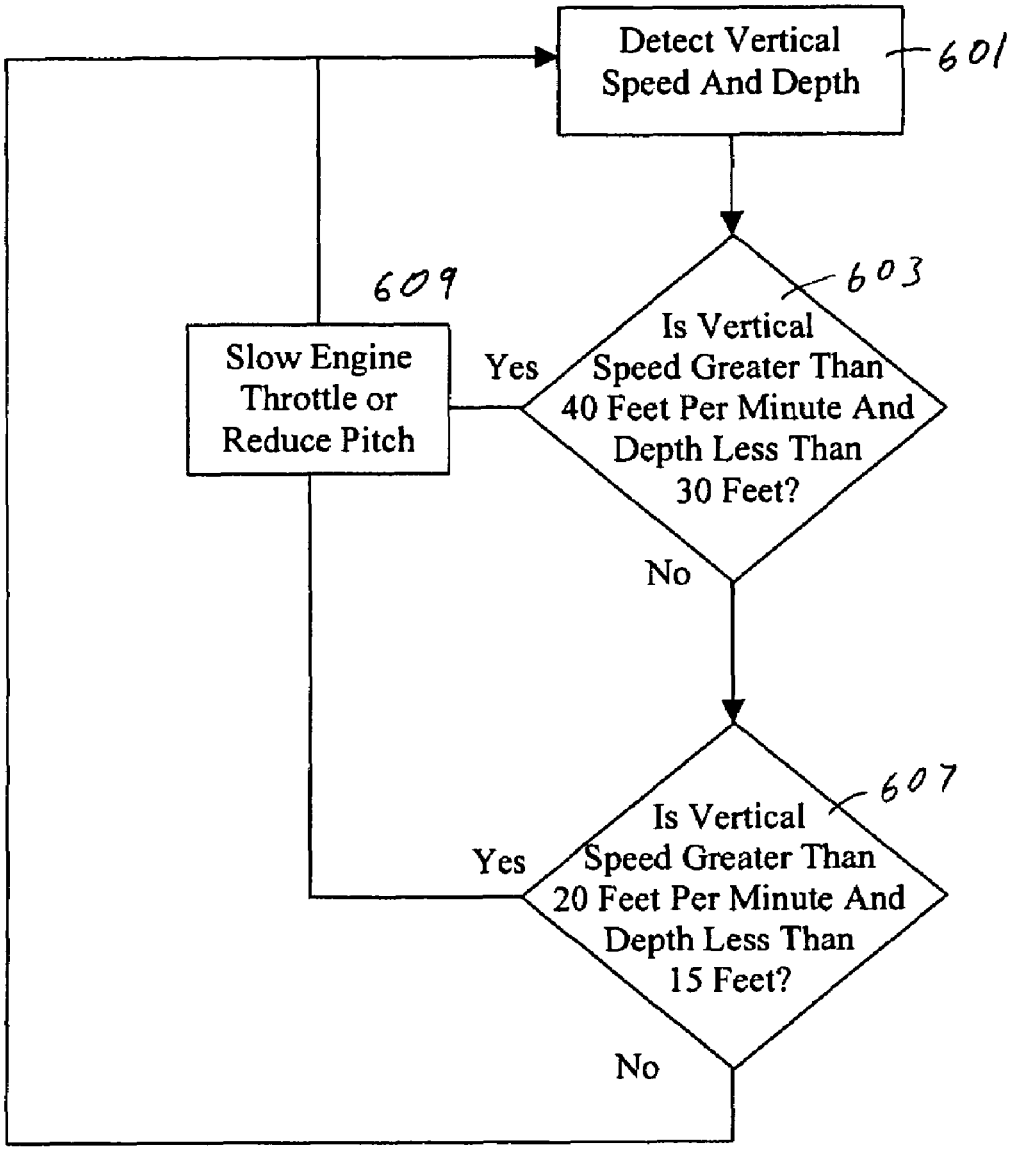
FIG. 6 is a control system flow chart.

In another embodiment, the system can slow the submersible as it approaches the surface to prevent the submersible from flying out of the water. In this embodiment, the system monitors the vertical speed and depth. If the submersible approaches the surface too quickly, the submersible can fly out of the water and possibly cause damage as it splashes back to the water. To avoid this problem, the inventive system can monitor the speed and depth and reduce the vertical speed if the craft approaches the surface too quickly. With reference to FIG. 6, the vertical speed and depth are monitored 601. If the vertical speed is greater than 40 feet per minute and the depth is less than 30 feet 603, the system can reduce the engine throttle or pitch to reduce the vertical speed 609. If the speed is not great than 40 feet per minute or the depth is not less than 30 feet 603, the system checks to determine if the speed is greater than 20 feet per minute and the depth is less than 15 feet 607. If the speed is greater than 20 feet per minute and the depth is less than 15 feet, the system can slow the engine or reduce the pitch 609. Of these conditions are not met, the system will continue to monitor the vertical speed and depth 601. While the conditions of 1) 40 feet per minute and 30 feet deep and 2) 20 feet per minute and 15 feet deep are specified as set points, these speeds and depths can be set to any values and any number of additional set points can be added to the system.

In another embodiment, the system can be portable device that issues warnings regarding the rate of ascent or descent rather than taking over the control of the underwater prolusion device. In this embodiment, the device may only have a pressure transducer and may be worn on the user's wrist or even integrated into a dive computer. If the rate of ascent or descent exceeds the safe level, the device can issue a visible light and audible warning signal that informs the diver that he or she needs to slow down or adjust the pitch of the propelled submersible.

If the system normally regulates the thrust and pitch, it may also have an override mechanism, which would allow the user to disable the inventive control system. This may be useful if the system malfunctions and shuts the propulsion off even when the rate of change in pressure is at a safe level and the user needs to resurface. Also there may be a situation where the diver has run out of air and needs to resurface as soon as possible even if this could may in injury to the diver's ears.

While the present invention has been described in terms of a preferred embodiment above, those skilled in the art will readily appreciate that numerous modifications, substitutions and additions may be made to the disclosed embodiment without departing from the spirit and scope of the present invention. For example, although the system has been described for use with a winged submersible, it would be equally suitable for any other type of underwater propulsion device. Those skilled in the art will readily appreciate that the present invention is in no way limited to mechanisms described above. It is intended that all such modifications, substitutions and additions fall within the scope of the present invention.

What is claimed is:

1. A safety system for an underwater propulsion device comprising:

a speed controller for the propulsion device;

a pressure transducer for measuring an ambient pressure;

an inclinometer for measuring the angle of the underwater propulsion device; and a speed regulator coupled to the speed controller and the pressure transducer; wherein the speed regulator slows the speed controller if a rate of pressure change detected by the pressure transducer is higher than a predetermined value and the speed regulator prevents the speed from exceeding a predetermined vertical speed associated with the angle of the propulsion device.

2. The safety system of claims 1 wherein the predetermined vertical speed is less than 60 feet per minute.

3. The safety system of claims 2 wherein the predetermined value is 60 feet per minute.

4. A safety system for an underwater propulsion device comprising:

a speed transducer for measuring the speed of the propulsion device;

an inclinometer for measuring the angle of the underwater propulsion device; and a pitch controller for the propulsion device that is coupled to the speed transducer and inclinometer;

wherein the pitch controller prevents a rate of ascent from exceeding a predetermined vertical rate by reducing the pitch to slow the rate of ascent.

5. A safety system for an underwater propulsion device comprising:

a speed controller for the propulsion device;

a speed transducer for measuring the speed of the propulsion device;

an inclinometer for measuring the angle of the underwater propulsion device; and a speed regulator coupled to the speed controller, the speed transducer and the inclinometer;

wherein the speed regulator prevents the speed from exceeding a predetermined vertical rate associated with the angle of the propulsion device.

6. The safety system of claim 5 wherein the predetermined value is 60 feet per minute.

* * * * *